United States Patent [19]

Meyman

[11] 4,422,836

[45] Dec. 27, 1983

[54] ROTARY MACHINE WITH PERIPHERALLY CONTACTING ROTORS AND END FACE SEALING PLATE

[76] Inventor: Usher Meyman, 230 Ocean Pkwy, Apt. E3, Brooklyn, N.Y. 11218

[21] Appl. No.: 298,475

[22] Filed: Sep. 1, 1981

[51] Int. Cl.[3] ..... F01C 1/02; F01C 17/02; F01C 19/08; F01C 21/00

[52] U.S. Cl. ..... 418/56; 418/58; 418/59; 418/132; 418/135; 418/178; 384/271

[58] Field of Search ..... 418/56, 58, 59, 131–135, 418/178, 196; 384/264, 271

[56] References Cited

U.S. PATENT DOCUMENTS

| | | | |
|---|---|---|---|
| 710,756 | 10/1902 | Colbourne | 418/135 |
| 1,646,056 | 10/1927 | Evensen | 384/271 |
| 2,776,086 | 1/1957 | Selden | 418/196 |
| 2,862,723 | 12/1958 | Peras | 384/271 |
| 3,207,425 | 9/1965 | Morse | 418/58 |
| 3,748,063 | 7/1973 | Putnam | 418/132 |
| 3,890,068 | 6/1975 | Davidson | 418/132 |
| 4,078,872 | 3/1978 | Teruyama | 418/132 |

*Primary Examiner*—John J. Vrablik
*Attorney, Agent, or Firm*—Ilya Zborovsky

[57] ABSTRACT

A rotary machine has a plurality of rotors rolling over one another and defining therebetween and end covers at least one working chamber, and at least one sealing plate at at least one side of the rotors and arranged so that an opposite side of the sealing plate communicates with the working cavity and the working medium flowing to the opposite side of the sealing plate presses the latter against one end face of the rotors. Insert members of bearing have conical surfaces receiving the shaft and can turn about their axes to compensate for wear.

13 Claims, 12 Drawing Figures

Fig. 1
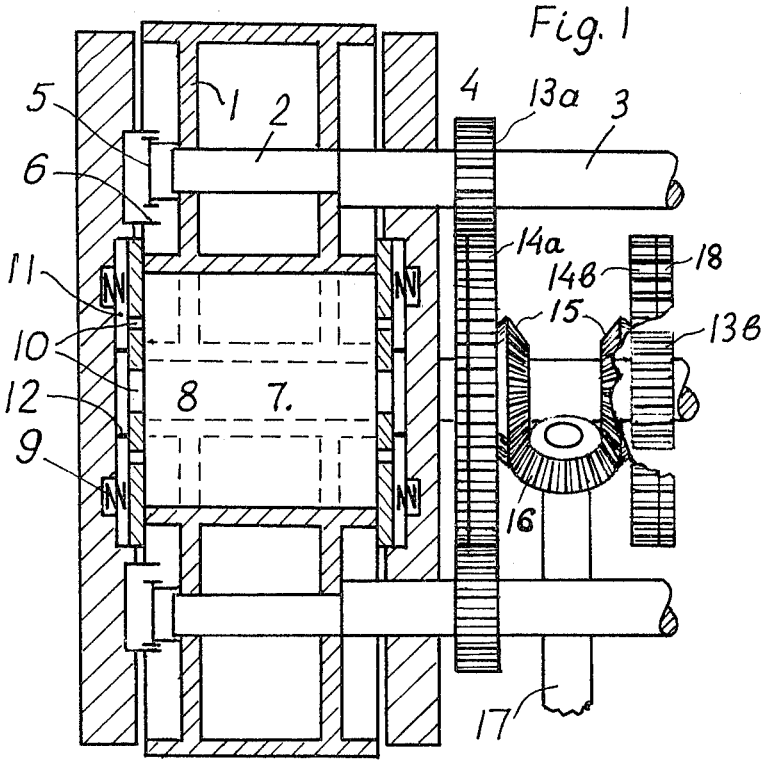
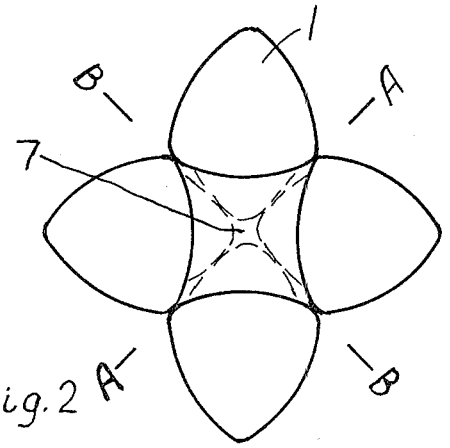
Fig. 2

Fig. 3
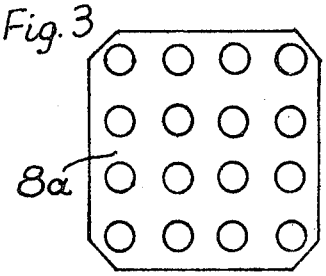
Fig. 9
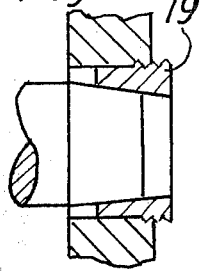
Fig. 10
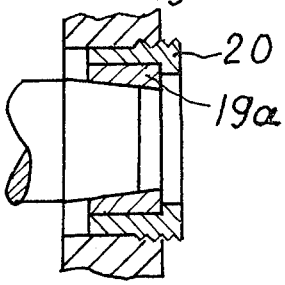
Fig. 5
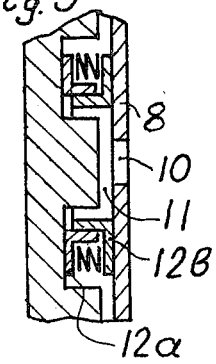
Fig. 4
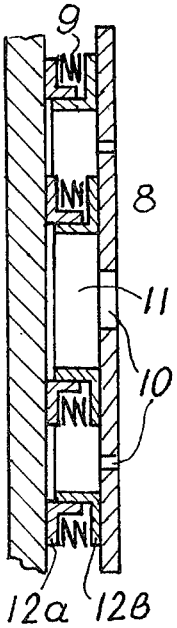
Fig. 11
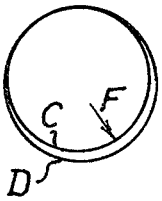
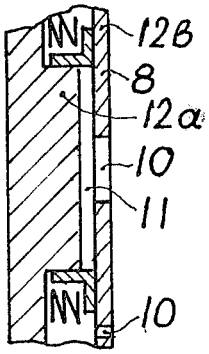
Fig. 6
Fig. 7
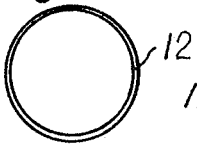
Fig. 8
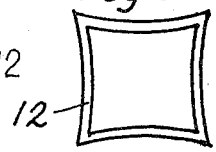
Fig. 12
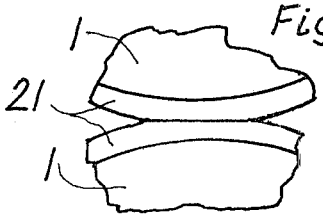

ROTARY MACHINE WITH PERIPHERALLY CONTACTING ROTORS AND END FACE SEALING PLATE

BACKGROUND OF THE INVENTION

The present invention relates to a rotary machine and more particularly to a multi-rotor rotary machine.

A multi-rotor machine of the inventor is known. It has rotors mounted on eccentric shaft and rolling without slippage over one another so that they form a plurality of working cavities between the rolling working surfaces of rotors and covers. The rotary machine is provided with means for synchronizing rotation of the rotors. This machine possesses, however, the disadvantage in the fact that wear of end faces of rotors and covers takes place, whereby hermetization of the working cavities is difficult. Moreover, there is wear of bearings of the eccentrics which can lead to striking of the rotors against one another.

SUMMARY OF THE INVENTION

Accordingly, it is an object of the present invention to provide a rotary machine which avoids the disadvantages of the prior art.

In keeping with these objects and with others which will become apparent hereinafter, one feature of the present invention resides, briefly stated, in a rotary machine in which in addition to rotors and covers, at least one sealing plate is provided at least one side on the rotors and arranged so that at the side opposite to the rotors the sealing plate has a hollow adapted to be filled with a working medium from a working cavity, so as to press the sealing plate against one end face of the rotors.

Still another feature of the present invention resides in the fact that insert members of bearings have conical inner surfaces receiving the shafts and are turnable about their axes to compensate for wear.

The novel features of the present invention will be defined in the claims; the invention itself, however, will be best understood from the following description which is accompanied by the following drawings.

BRIEF DESCRIPTION OF THE DRAWINGS

FIG. 1 is a view showing a section of an inventive rotary machine with four rotors;

FIG. 2 is a schematic view of the arrangement of the rotors of the inventive machine;

FIG. 3 is a view showing a sealing plate for the inventive machine with sixteen rotors;

FIGS. 4, 5 and 6 are views showing partitions associated with the sealing plates;

FIGS. 7 and 8 are plan views of the partitions of the associated sealing plate;

FIGS. 9 and 10 are views showing sliding bearing for rotor shafts of the inventive machine;

FIG. 11 is a schematic view illustrating turning of the insert of the sliding bearing; and FIG. 12 is a view showing contact of the rotors provided with elastic coatings.

DESCRIPTION OF PREFERRED EMBODIMENTS

A rotary machine in accordance with the present invention includes a plurality of rotors 1 (FIG. 1) mounted on eccentrics 2 of shafts 3 and located between end covers or plates 4. The covers are connected with one another by bolts which are not shown in the drawings.

Rotors are provided with gears 5 which mesh with gears 6 mounted in at least one of the covers 4. The number of teeth ratio may be, for example, 3:4. Thereby during the rotation of the shafts 3 each rotor 1 rotates about the axis of the eccentric 2 in one direction and simultaneously about the axis of the shaft 3 in the opposite direction. The rotors of each pair, which contact one another, always remain symmetrical relative to their contact plane AA or BB and roll over one another without slippage (FIG. 2). The volume of the working cavity 7 formed between the rotors changes cyclically from a minimum (the rotors' position shown in dotted lines) to a maximum. Since in any position the rotors do not extend beyond the limits of describing the same imaginary square and always contact it at four sides, there is a possibility for formation of additional working chambers by mere addition in the plane of the drawing of additional rotors.

Sealing plates 8 are arranged between the covers 4 and rotors 1. They are spring-biased by springs 9. The sealing plate may be installed in a recess of the cover or outside of the cover (FIG. 4). The sealing plates 8 have through going openings 10 communicating the working cavity 7 with a hollow 11 between the sealing plates 8 and covers 4. The shape and size of the sealing plates are selected so they overlap, as a minimum, the borders of the working cavity which change during the rotation of the rotors. They also may have the shape and size of the covers. In the second case, they have cutouts for accommodating the synchronizing gears 6 or shafts 3.

In the event if the rotors form more than one working cavity, one sealing plate may be provided for each working cavity, or a common sealing plate 8*a* (FIG. 3) may be provided for all working cavities. The latter has cutouts for extension of the shafts 3 or the synchronizing gears therethrough.

When the pressure in the working cavity increases, it is trasferred through the openings 10 into the hollow 11 in which the exposed part of the sealing plate surface facing away from the rotors is greater than the the exposed part of the sealing plate surface facing toward the working cavity 7. The thus formed pressure differential reliably presses the sealing plate to the end faces of the rotors. Before starting of the pressure in the working cavity, the sealing plates are urged to the end faces of the rotors by the springs 9. If the rotors are mounted with the possibility of their displacement along the eccentrics, the sealing plate 8 may be installed only in one of the covers, and the wear in the opposite end faces of the rotors will be compensated by the respective displacement of the rotors. If in this case the engine (rotary machine) is installed so that their shafts 3 are located vertically and the sealing plate is accommodated in the upper cover, then in the initial moment it will be pressed to the end faces of the rotors under the action of its own weight and the springs 9 can be dispensed with.

At least one closed partition 12 may be arranged in the hollow 11 and subdivide the latter into zones which can be annular and communicate with the working cavity through the openings 10. When the rotors spread apart, the openings are opened in succession one after the other so that the pressure in the hollow 11 propagates in a stepped manner and thereby excludes excessively strong pressing of the sealing plates against the end faces of the rotors in the beginning of the working stroke.

The partitions 12 may be formed by a telescopable members 12*a* and 12*b* (FIGS. 4,5,6) which are biased by springs 9. The members 12*a* and/or 12*b* may be of one piece with the covers 4 and/or sealing plates 8 (FIG. 6), or attached thereto (FIG. 4). They also may be arranged independently (FIG. 5). The partitions 12, that is the members 12*a* and 12*b* may have different shape in plane as can be seen from FIGS. 7 and 8.

The distance between the sealing plates 8 and the covers 4 which increases because of the parts wear to a certain limit, can be reduced by adjustment of the bolts connecting the covers with one another. The shafts of the rotors are provided with gears 13*a* and 13*b* which are in engagement with gears 14*a* and 14*b* rotating in opposite directions. Conical gears 15 connected therewith transmit the torque to a conical gear 16 of an output shaft 17.

Teeth wear in the engagement of the gears 13*a* and 13*b* with the gears 14*a* and 14*b* causes additional turning of the former by a certain angle in direction of transmission of torque. There, all rotors turn in direction of their rotation by an additional angle, whereby the symmetry of their rotation do not deteriorate. Because of this, a conventionally possible occurance of gaps because of nonsymmetrical arrangement of the neighboring rotors in known machines are excluded in the inventive machine. A play which takes place during wear of meshing gears and can lead to assymetrical turning of these multicavity machine rotors which participate in suction stroke while other rotors take part in other strokes, is eliminated by the gears 18 mounted freely but connected with the gears 14*a* and 14*b* by not shown springs acting in a plane of rotation of these gears.

Bearings of the rotor shafts and/or eccentrics (FIG. 9) have an insert with an inner conical surface, and an outer cylindrical surface provided with a thread. The inserts are identified by reference numeral 19 in FIG. 9. When the conical surface of the insert wears relatively uniformly the thus formed play is eliminated by displacing the inserts in direction of greater diameter by turning the insert about the axis of the shaft. The turning of the insert 19 may be performed periodically during preventive examinations, or automatically by a spring, or hydraulic or pneumatic devices driven by elements of the machine.

When the wear takes place only at one side, an insert 19*a* (FIG. 10) can be freely arranged, with a slide fit, in a bush 20 having a thead on its outer surface. The moment of friction between the cooperating surfaces of the insert 19*a* and the bush 20 is greater than the moment of friction between the surfaces of the shaft and the bush. In this case (see also FIG. 11) when the force F which is a load upon the bearing, displaces successively over a circumference C identifying the insert, it will roll over the circumference D identifying the inner surface of the bush 20, into the same direction. During this process, the circumference C will rotate about its center in the opposite direction with a speed which decreases with the decrease of the difference in the diameters of these circumferences.

Since in the event of conventional plays of the bearing the diameters ratio approaches zero, the insert will slowly turn by itself during high speed rotation of the shaft so as to contribute to the uniformity of its wear. The displacement of the bush 20 with the insert 19*a* in direction of the greater diameter is carried out by one of the above described methods.

A thin layer of elastic (resilient) and nonburning material 21, for example, perlon can be provided on the working surface of the rotors. The layer may be also composed of polyacrylonitryl fibers or other materials. This makes possible to reduce requirements to the accuracy of rotors manufacture and wear resistance of the bearings. Scale settling on the working surfaces of the rotors compensates for possible wear because of microcracks of their surfaces.

Gas exchange may be performed through openings in a cover and cutouts in the working surface of a rotor.

The rotary machine can include two or more parallel one or two cavity sections arranged symmetrically to the axis of the output shaft 17 and having common shafts. Means for synchronization of rotor rotation may be formed by nonround gears attached to the rotors and meshing with one another so that their toothed rims follow the shape of rotors.

The invention is not limited to the details shown since various modifications and structural changes are possible without departing from the spirit of the same. What is intended to be protected by Letters Patent:

I claim:

1. A rotary machine, such as a rotary combustion engine and the like, comprising a plurality of rotors rotatable on eccentric shafts about substantially parallel axes and having peripheral surfaces, said rotors being located relative to one another and each having a shape such that said rotors during the rotation about said axes roll by their peripheral surfaces one over the other without slippage and together bound at least one working cavity which is open at its both axial sides but is permanently closed peripherally by said peripheral surfaces of said rotors;

two covers located at both axial sides of said rotors to close said cavity at the both axial sides;

at least one sealing plate arranged to adjoin one axial end face of said rotors so that it overlaps at least one working cavity, said sealing plate being arranged to form at its side opposite to said rotors a hollow;

means for communicating said hollow with said working cavity so that a working medium flows into said hollow and presses said sealing plate at said opposite side toward and against said end faces of said rotors; and means for synchronizing rotation of said rotors including gears with inner toothed rims, mounted on at least one of said covers, and gears with outer toothed rims, mounted on said motors and meshing with said gears with said inner toothed rims.

2. A rotary machine as defined in claim 1, wherein said communicating means includes a through-going opening extending through said sealing plate and communicating said hollow with said working cavity.

3. A rotary machine as defined in claim 1, wherein said sealing plate has at its side facing away from said rotors and toward said hollow a first surface, and at its side facing toward said rotors and toward said working cavity a second surface, said first surface having a first portion exposed to the action of the working medium from said hollow, and said second surface having a second portion exposed to the action of the working medium from said working cavity directly, said first portion being greater than said second portion so as to provide for a pressure differential urging said sealing place toward and against said end faces of said rotors.

4. A rotary machine as defined in claim 1; and further comprising a second such sealing plate arranged to adjoin the other axial face of said rotors so as to overlap at least one working cavity at its opposite side and to form a second such hollow, and second such communicating means for communicating said second hollow with said working cavity to allow flowing of the working medium into the former and to thereby press said second sealing plate toward and against said other end faces of said rotors.

5. A rotary machine as defined in claim 1, wherein said sealing plate is located near to one of said covers so as to form said hollow therebetween; and further comprising means subdividing said hollow into at least two zones.

6. A rotary machine as defined in claim 5, wherein said subdividing means includes at least one closed partition subdividing said hollow so that said zones are annular.

7. A rotary machine as defined in claim 5, wherein each of said partitions includes two telescopable partition members movable relative to one another.

8. A rotary machine as defined in claim 7; and further comprising spring means pressing said telescopable partition members away from one another.

9. A rotary machine as defined in claim 1; and further comprising at least one spring element pressing said sealing plate toward said rotors even in the event of absence of the working medium in said hollow.

10. A rotary machine as defined in claim 1; and further comprising sliding bearings each mounting a respective one of said shafts and having an insert member provided with an inner conical surface cooperating with a respective one of said shafts, an outer cylindrical surface with a thread, and being turnable about its axis.

11. A rotary machine as defined in claim 10, wherein each of said insert members has two annular parts insertable into one another and formed so that an inner one of said parts is provided with an inner surface forming said conical surface, an outer one of said parts has an outer surface forming said cylindrical surface with thread, and said parts having cooperating outer and inner cylindrical surfaces respectively.

12. A rotary machine as defined in claim 10; and further comprising means for turning said insert member about its axis.

13. A rotary machine as defined in claim 1, wherein said rotors have working surfaces coated with elastic refractory material.

* * * * *

UNITED STATES PATENT AND TRADEMARK OFFICE

CERTIFICATE OF CORRECTION

PATENT NO. : 4,422,836

DATED : December 27, 1983

INVENTOR(S) : Usher Meyman

It is certified that error appears in the above-identified patent and that said Letters Patent is hereby corrected as shown below:

Column 4, claim 1, line 53, "motors" should read -- rotors --.

Signed and Sealed this

*Twelfth* Day of *March 1985*

[SEAL]

*Attest:*

DONALD J. QUIGG

*Attesting Officer*

*Acting Commissioner of Patents and Trademarks*